US009890535B2

(12) United States Patent
Breyer et al.

(10) Patent No.: US 9,890,535 B2
(45) **Date of Patent: *Feb. 13, 2018**

(54) GUTTER DEBRIS BARRIER SYSTEM

(71) Applicant: All Weather Armour, LLC, Sullivan, WI (US)

(72) Inventors: Scott Breyer, Dousman, WI (US); David Catherman, Madison, WI (US)

(73) Assignee: All Weather Armour, LLC, Sullivan, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/340,092

(22) Filed: Nov. 1, 2016

(65) Prior Publication Data

US 2017/0044771 A1 Feb. 16, 2017

Related U.S. Application Data

(63) Continuation of application No. 14/879,274, filed on Oct. 9, 2015, now Pat. No. 9,487,955.

(60) Provisional application No. 62/061,887, filed on Oct. 9, 2014.

(51) Int. Cl.

| | |
|---|---|
| ***E04D 13/00*** | (2006.01) |
| ***E04D 13/076*** | (2006.01) |
| ***E04D 13/064*** | (2006.01) |
| *E04D 13/04* | (2006.01) |

(52) U.S. Cl.

CPC ..... *E04D 13/0767* (2013.01); *E04D 13/064* (2013.01); *E04D 13/076* (2013.01); *E04D 13/0762* (2013.01); *E04D 2013/0413* (2013.01); *E04D 2013/0418* (2013.01)

(58) Field of Classification Search

CPC ..... E04D 2013/0413; E04D 2013/0418
USPC ..... 52/11, 12
See application file for complete search history.

(56) References Cited

U.S. PATENT DOCUMENTS

| | | | | |
|---|---|---|---|---|
| 5,010,696 | A * | 4/1991 | Knittel | E04D 13/076 210/474 |
| 7,310,912 | B2 | 12/2007 | Lenney et al. | |
| 7,975,435 | B2 | 7/2011 | Lenney et al. | |
| 8,079,183 | B2 | 12/2011 | Lenney | |
| 8,438,787 | B2 | 5/2013 | Lenney et al. | |
| 8,479,454 | B2 | 7/2013 | Lenney et al. | |
| 9,021,747 | B2 | 5/2015 | Lenney et al. | |
| 2006/0101722 | A1* | 5/2006 | Ealer, Sr. | E04D 13/076 52/12 |
| 2007/0234647 | A1* | 10/2007 | Higginbotham | E04D 13/076 52/12 |
| 2008/0163561 | A1* | 7/2008 | Lenney | E04D 13/076 52/12 |
| 2010/0287846 | A1* | 11/2010 | Lenney | E04D 13/0762 52/12 |

(Continued)

*Primary Examiner* — Ryan D Kwiecinski
(74) *Attorney, Agent, or Firm* — Boyle Fredrickson, S.C.

(57) ABSTRACT

A gutter debris barrier system for preventing debris from entering a gutter includes a frame that is attached to a fascia of a building and a filter screen. The frame may include a floor with slots punched therein, with ribs on either side of the slots that form channels. The channels may be tapered to improve the speed and efficiency of heat transfer, and also to funnel water down into the gutter. The ribs may have planar upper surfaces or tips lying in a common horizontal plane and supporting a flat filter screen.

21 Claims, 7 Drawing Sheets

(56) References Cited

U.S. PATENT DOCUMENTS

| | | | | |
|---|---|---|---|---|
| 2013/0248672 | A1* | 9/2013 | Martin | E04D 13/076<br>248/312.1 |
| 2014/0215929 | A1* | 8/2014 | Lenney | E04D 13/076<br>52/12 |
| 2015/0020462 | A1* | 1/2015 | Iannelli | E04D 13/064<br>52/12 |
| 2016/0060870 | A1* | 3/2016 | Martin | E04D 13/064<br>52/12 |

* cited by examiner

GUTTER DEBRIS BARRIER SYSTEM

CROSS-REFERENCE TO RELATED APPLICATION

The present application is a continuation of U.S. patent application Ser. No. 14/879,274, filed Oct. 9, 2015, and entitled Gutter Debris Barrier System, which claims priority on U.S. Provisional Patent Application Ser. No. 62/061,887, filed Oct. 9, 2014 and entitled Gutter Containment Protection System, both of which are incorporated by reference herein in their entirety.

BACKGROUND OF THE INVENTION

1. Field of the Invention

The present invention relates to gutter debris barrier systems, also known as gutter guards, which are placed on or about rain gutters located adjacent to a roof of a building to permit the passage of water while preventing debris from entering into and collecting in the gutter.

2. Discussion of the Related Art

A common problem with rain gutters is that they become clogged or jammed with various debris including leaves, needles, shingle sand, and other materials that fall onto the gutter. Functionality of the rain gutter is dramatically decreased once debris enters the gutter. Consequently, a property owner is required to repeatedly clean out rain gutters over the course of a year. To address this issue, gutter debris barrier systems, or gutter guards, have been introduced to prevent debris from collecting within the gutter. The goal of gutter guards is to prevent debris from entering the gutter while still maintaining water flow through the gutter guard and into the gutter, such that water is not dripping down the outside of the gutter, and ultimately the building.

The most primitive debris barrier systems consist of a guard that simply included a screen with multiple holes that is laid across the gutter. These systems attempted to balance the need for holes large enough for sufficient flow of water while small enough to prevent debris from flowing through the screen. Over time, more sophisticated guard systems were developed. For instance, mesh filter elements have been used with sufficiently small holes to allow the flow of water therethrough. These mesh filter elements often are supported by a frame that includes channels and holes to guide the flow of water down into the gutter. These systems block substantially all debris from entering while allowing high volumes of water to pass through to the gutter. U.S. Pat. No. 7,310,912, which is incorporated herein by reference in its entirety, discloses such a system.

Both gutter systems and gutter guards can experience problems when freezing temperatures are encountered. For instance, a gutter that has been clogged with debris will pool water, which can ultimately freeze and cause further backup. Even where gutter guards are used, snow or water can enter into the gutter and freeze along or adjacent to the gutter. These issues can be exacerbated by runoff that results from the melting of snow and ice on the roof, which then runs down into the relatively cold gutter and re-freezes. This can result in ice dam formation in and around the gutter and on the roof. Further still, when functionality of a gutter and/or gutter guard is compromised, large icicles can form on the outer surface of the gutter. These icicles contribute significant weight to the gutter. Additionally, in the event that the mesh filter element freezes over, snow and ice can gather on the top of the filter element. The weight of this buildup can be significant, requiring the mesh filter element to withstand substantial loads.

To avoid the freezing effects discussed above, various deicing gutters or gutter guard systems utilize an electrical heating element such as a wire or coil. The heating element can be mounting to the gutter, to the gutter guard, or beneath the roofline. Assuming the gutter is metallic, the heat will be transmitted throughout the gutter to thaw any ice buildup and prevent further freezing.

A number of the drawbacks experienced with previous gutter guard systems were largely alleviated with the introduction of the gutter debris barrier system described in U.S. Pat. Nos. 8,079,183 and 8,438,787, which are incorporated herein by reference in their entirety. The gutter debris bather system disclosed in these patents features a rigid frame with a filter element supported above the frame. One side of the frame is mounted beneath the shingles of the roof, and the other side is attached to the lip of the outer wall of the gutter. Longitudinally extending ribs are located within the frame, with slotted channels being formed between the ribs for the direction of water into the underling gutter. The ribs are generally rectangular when viewed in transverse cross section, and their sides thus extend generally perpendicularly from the floor of the frame. Activation of a heating element located adjacent to the frame heats the frame, the filter element, the flange, and the gutter.

While serving as an effective debris barrier and encouraging deicing in and around the gutter, there are several disadvantages to this system.

First, the frame is mounted beneath the shingles of the roof, which can cause damage to the roof and/or shingles. Furthermore, by peeling back the shingles to install the frame, any warranty on the shingles may be voided.

Another drawback to this system is that the channels are flat rather than tapered, creating the risk of the pooling of water in the channels in the presence of even small amounts of debris or non-planarity of the channels. The pooled water can freeze with resultant detrimental effects. Additionally, in having the ribs that extend at substantially right angles from the floor of the gutter, the distance through the floor and up each rib can result in a relatively long heat transfer path from the heat source through the floor, to the ribs, and ultimately the filter element. Heating efficiency thus is degraded.

In addition, the presence of rectangular ribs and the associated sharp transitions between ribs produces a relatively weak frame.

Thus, there remains room for improvement in gutter debris barrier systems by providing a system that is mountable about the gutter without interfering with the shingles on the roof.

Additionally, there is need for a gutter debris barrier system with different ribs that facilitate a shorter heat travel path and reduce pooling of water.

There is additionally a need for a gutter debris barrier system having a frame that is stronger than known frames.

SUMMARY OF THE INVENTION

In accordance with an aspect of the present invention, a debris barrier system includes a frame adapted to overlie at least a portion of the gutter and a filter screen that covers at least a portion of the frame. The frame includes a floor with at tapered channels separated by ribs that extend upwardly from the floor. The ribs may have flat upper surfaces or tips lying in a common horizontal plane and supporting a flat filter screen.

The floor of the frame may have slots within the channels to allow water to pass through the frame and into the underlying gutter. The slots may be located along a lowest point of each channel to encourage water passage therethrough.

In accordance with another aspect of the system, a mounting bracket that extends longitudinally along the gutter can be mounted to the fascia of the building. The frame may include a flange that extends from a first or inner side wall of the frame and which can be attached to the mounting bracket. In one embodiment, the flange is releasably held within a c-shaped channel of the mounting bracket. A second or outer side wall of the frame can then be secured to the second or outer side of the gutter. Thus, the frame is suspended over the top of the gutter.

In accordance with another aspect of the system, the frame may include a channel for receiving a heating element. The frame and the filter screen may be made of a heat conductive material such as aluminum to facilitate heat transfer from the heating element to the remainder of the system.

These and other aspects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof. It is hereby disclosed that the invention include all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION

Figure 1:
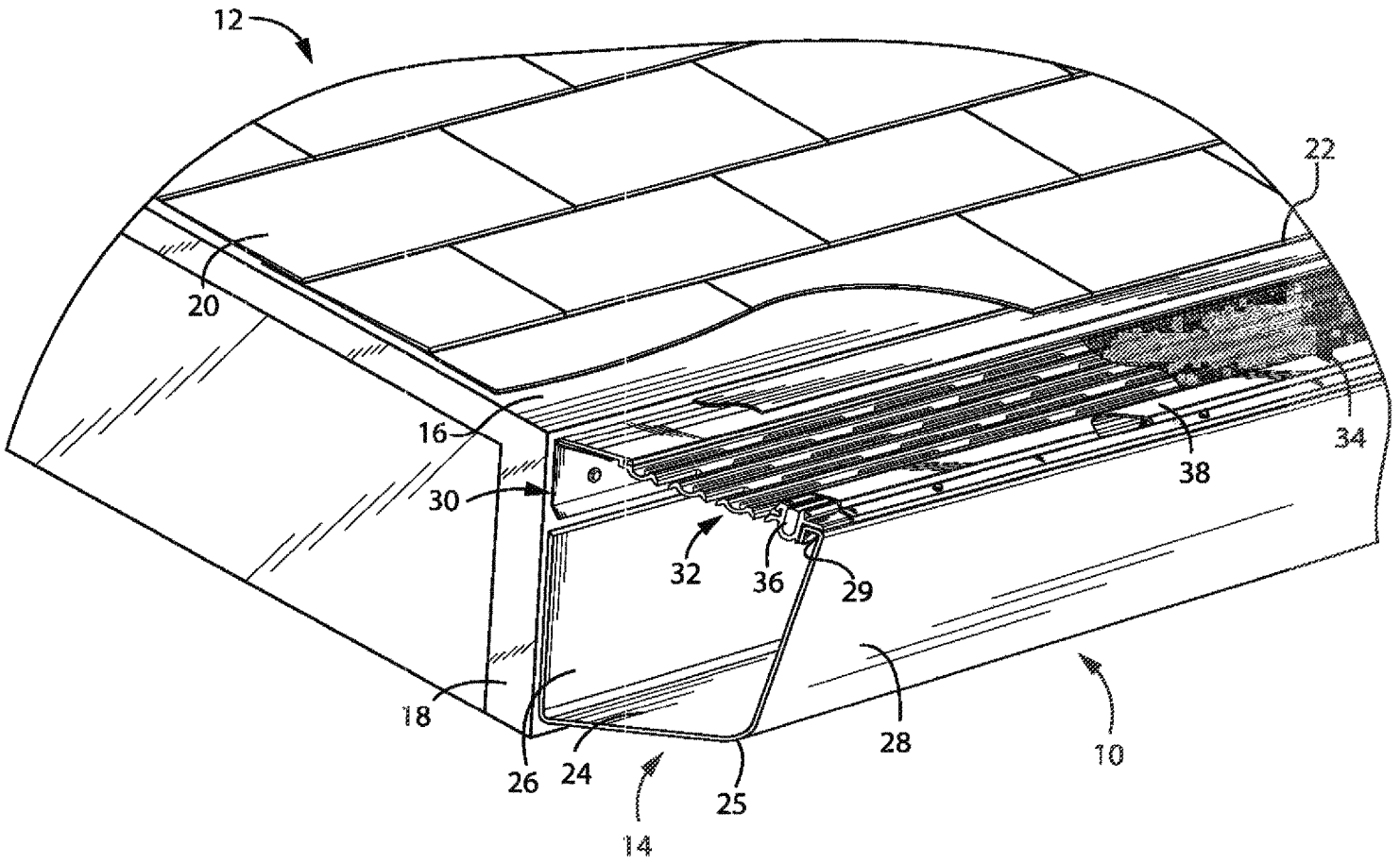
FIG. 1 is a partially cut away top perspective view of a gutter debris barrier system constructed in accordance with the invention and installed above a gutter.
Figure 2:
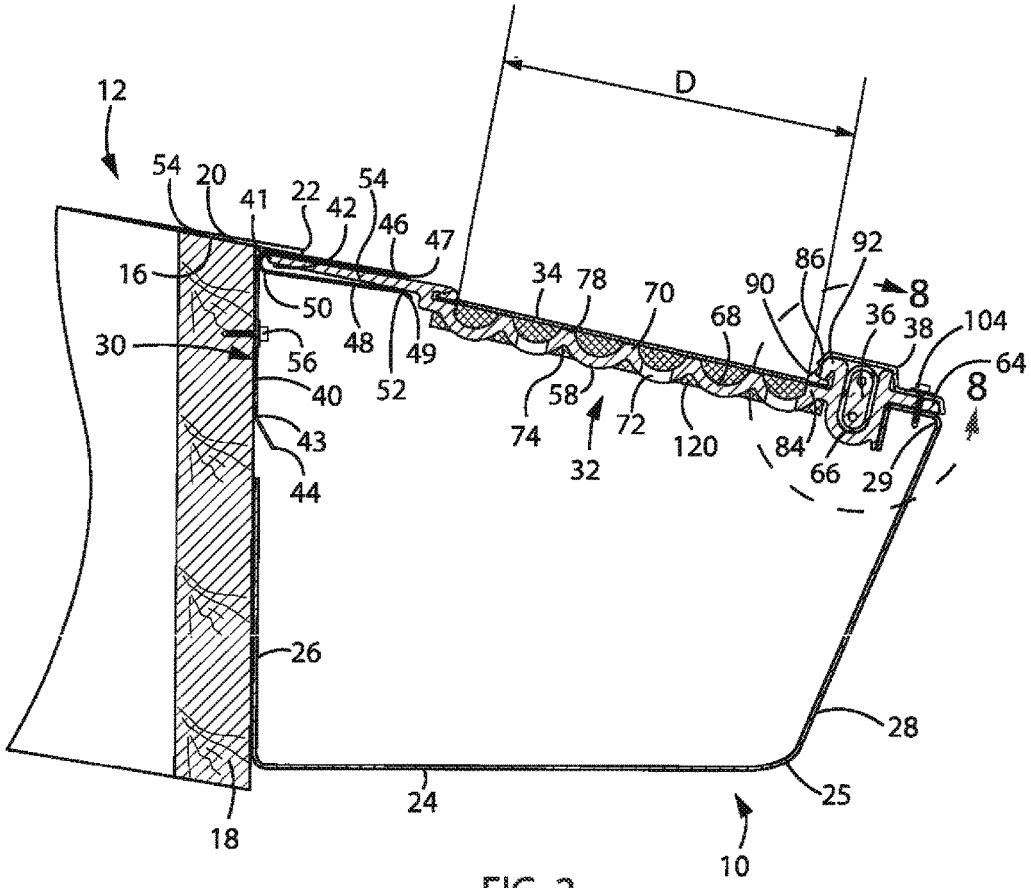
FIG. 2 is a cross sectional end elevation view of the gutter debris barrier system.
Figure 3:
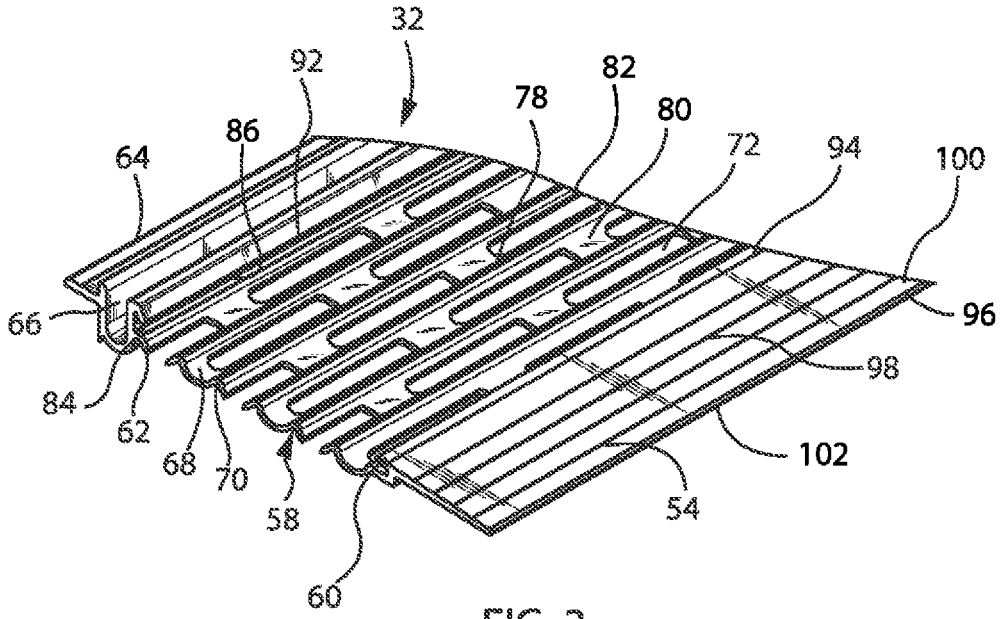
FIG. 3 is a top perspective view of a section of a frame of the gutter debris barrier system.

Referring now to the drawings and initially to FIGS. 1 and 2, a gutter debris barrier system 10 as mounted on a building 12 is shown as mounted about a gutter 14, a roof 16, and a fascia 18 of the building 12. The fascia 18 extends downwardly from the roof 16. The roof 16 is covered on the top by shingles 20, and has a drip lip 22 that extends beyond the fascia 18. The gutter 14 is mounted to the building 12 adjacent the fascia 18. The gutter debris barrier system 10 is mounted over the gutter 14 and includes a mounting bracket 30 attached to the fascia 18, a frame 32 located over the bottom 24 of the gutter 14 and supported at its inside on the fascia 18 and at its outside on the gutter 14, and a filter screen 34 supported on the frame 32. An optional heating element 36 may be mounted on the frame 32 and covered by a cover 38.

Still referring to FIGS. 1 and 2, the gutter 14 is generally trapezoidal in transverse cross section and includes a bottom 24, an inner wall 26 positioned adjacent the fascia 18, and an outer wall 28 having an upper lip 29. The inner wall 26 typically extends substantially vertically, while the outer wall 28 generally is inclined upwardly away from the outer edge 25 of the bottom 24 of the gutter 14. The gutter 14 is mounted on the fascia 18 by brackets and hangers, not shown. The gutter 14 typically will be 5" to 6" wide at its upper end and about 5" to 6" deep.

Figure 7:
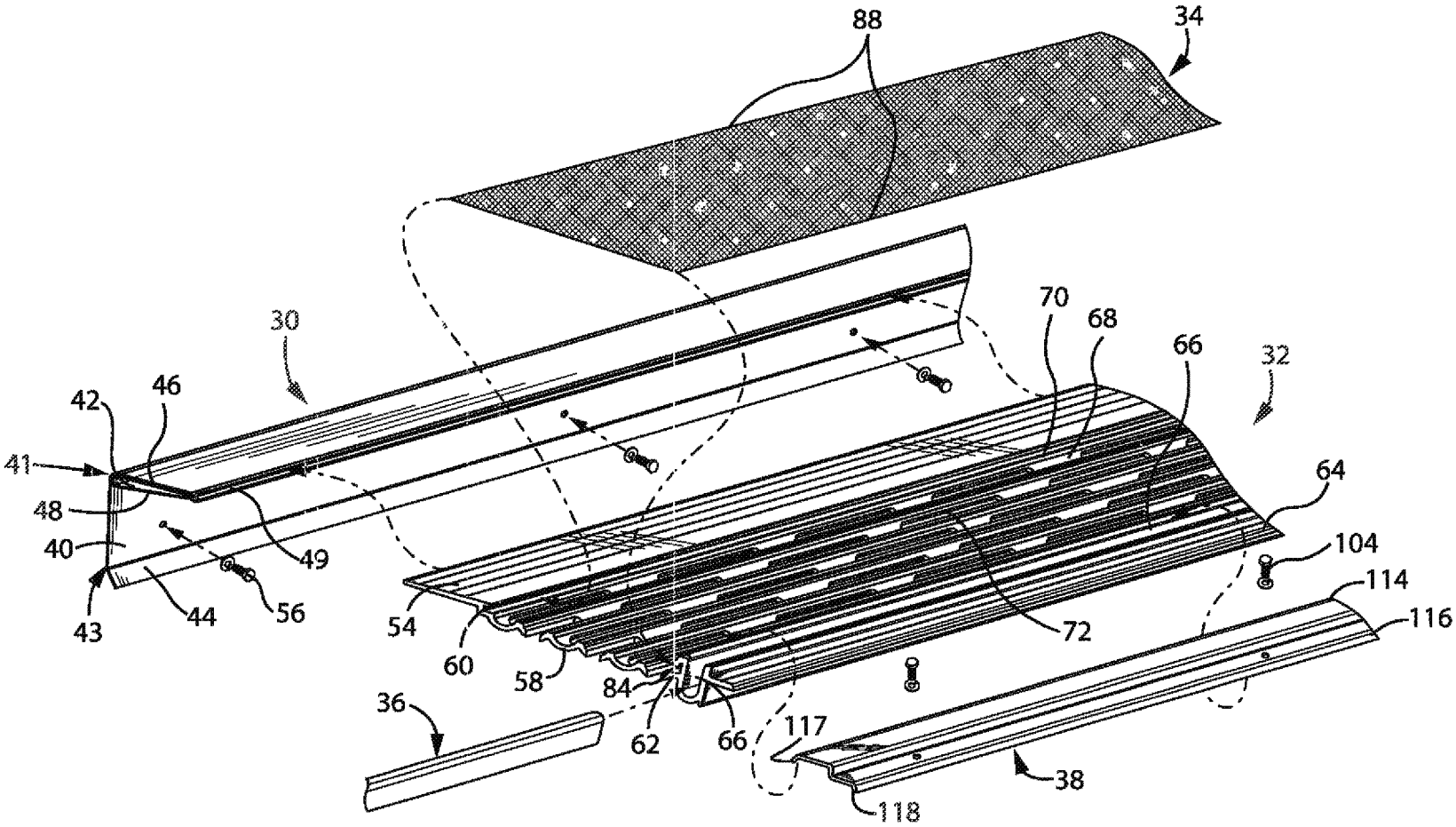
FIG. 7 is an exploded isometric view of the gutter debris barrier system.

Looking now to FIGS. 1, 2, and 7, the gutter debris barrier system 10 of the illustrated embodiment includes a frame 32 that is above the bottom 24 of the gutter 14, a mounting bracket 30 via which an inner portion of the frame 32 is mounted on the building 12, and a flat filter screen 34 supported on the frame 32 and having openings sized to permit to allow water to pass through while preventing debris from entry. By using the mounting bracket 30 in combination with the frame 32, the system 10 can be mounted to the fascia 18 and gutter 14 without interfering with the roof 16 or the shingles 20. Once mounted in place, the system 10 protects the gutter 14 from debris such as leaves and pine needles, while still allowing water to pass through down into the bottom 24 of the gutter 14.

Figure 6:
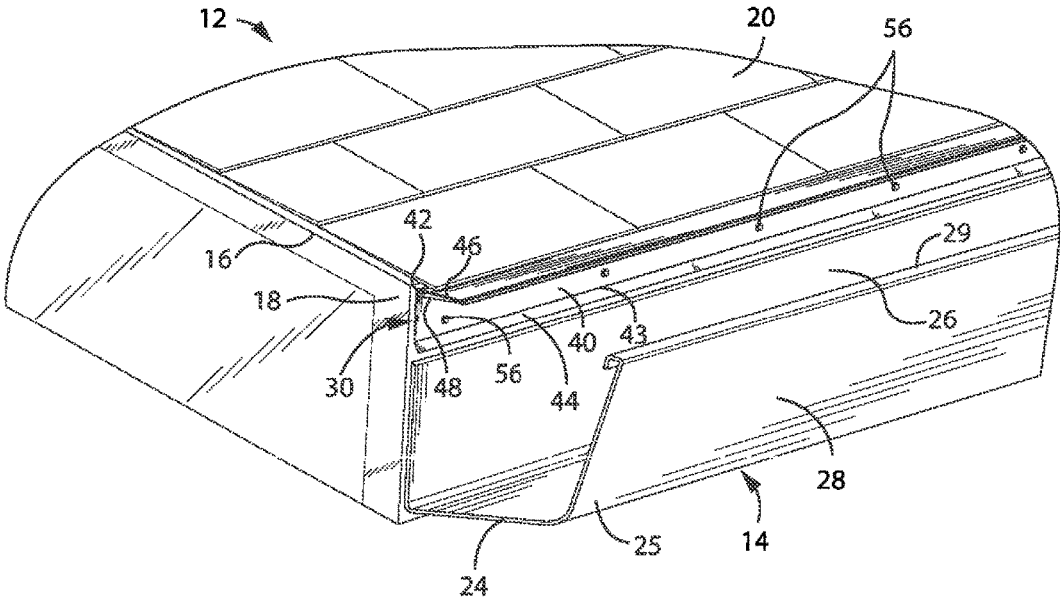
FIG. 6 is a partially cut away top perspective view of a mounting bracket of the gutter debris barrier system, installed above the gutter.

Looking to FIGS. 2 and 6, one embodiment of the mounting bracket 30 is shown being mounted to the fascia 18 and extending longitudinally along the building 12. The mounting bracket 30 may be made from relatively strong metal such as aluminum or steel. The mounting bracket 30 includes a mounting leg 40 that is generally vertical, a c-shaped channel 42 or c-channel that extends generally perpendicular outwardly from an upper end 41 of the mounting leg 40, and a drip edge 44 that is inclined downwardly and outwardly from a bottom edge 43 of the mounting leg 40. The mounting leg 40 can be attached to the fascia 18 of the building 12 by screws 56 (FIG. 7) or similar fasteners. As a result, the c-shaped channel 42 extends generally perpendicular and away from the fascia 18.

Still referring to FIGS. 2 and 6, the c-channel 42 is bordered from above by an upper leg 46 and from below by a lower leg 48. The lower leg 48 extends generally horizontally outwardly from the upper end 41 of the mounting leg 40. The upper leg 46 extends outwardly from the mounting leg 40 and is inclined toward the lower leg 48 so that the c-shaped channel 42 progressively narrows in thickness from its inner end 50 to outer end 52 so that the outer end 52 is substantially thinner than the thickness of a mounting flange 54 on the frame 32 (detailed below), resulting in the clamping of the mounting flange 54 in the c-channel 42 during assembly. Opposed flanges 47, 49 may be formed on the outer end 52 of the upper leg 46 and lower leg 48 to help guide entry of the mounting flange 54 of the frame 32 into the c-channel 42 during assembly.

While providing sufficient clearance to allow for the insertion of the mounting flange 54, the tapered shape of the c-shaped channel 42, formed by the converging upper leg 46 and lower leg 48 form a spring-clip that helps to secure the mounting flange 54 within the c-channel 42. This allows a user to install or remove the mounting flange 54 from the c-channel 42 without the use of tools, but does not allow the mounting flange 54 to freely fall out of the c-channel 42. Alternatively, the mounting flange 54 may be secured within the c-shaped channel 42, for instance, by a clipping mechanism or other attachment technique.

The c-shaped channel 42 of the mounting bracket 30 may be configured to be slightly longer in length than the mounting flange 54 such that the mounting flange 54 can be easily inserted into the c-shaped channel 42, and so that the c-shaped channel 42 can accommodate inward and outward movement of the mounting flange 54 resulting from thermal expansion and contraction of the frame 32.

The mounting leg 40 of the mounting bracket 30 may be mounted to the fascia 18 by screws 56, bolts, rivets, or other suitable attachment devices that are inserted through openings formed in the mounting leg 40 either before or during installation. When thus installed, the mounting bracket 30 is installed directly beneath the roof 16 and shingles 20 so that the upper leg 46 bordering the c-shaped channel 42 abuts or is disposed adjacent the bottom of the shingles 20 of the roof 16. As shown, the mounting bracket 30 should abut the roof 16 while being spaced above the gutter 14. This inhibits moisture from falling behind the mounting bracket 30 and behind the gutter 14. The height of the mounting bracket 30 may vary depending on the spacing between the gutter 14 and the roof 16. The mounting bracket 30 further facilitates movement of water towards the gutter 14 by the drip edge 44, which is angled towards the gutter 14 and guides any water that runs down the mounting bracket 30 back toward the gutter 14.

It should be noted that the mounting bracket 30 is not critical to the system 10 and could be replaced by or supplemented with a more traditional under-the-shingles mounting system such as the one disclosed in U.S. Pat. Nos. 8,079,183 and 8,438,787.

Figure 4:
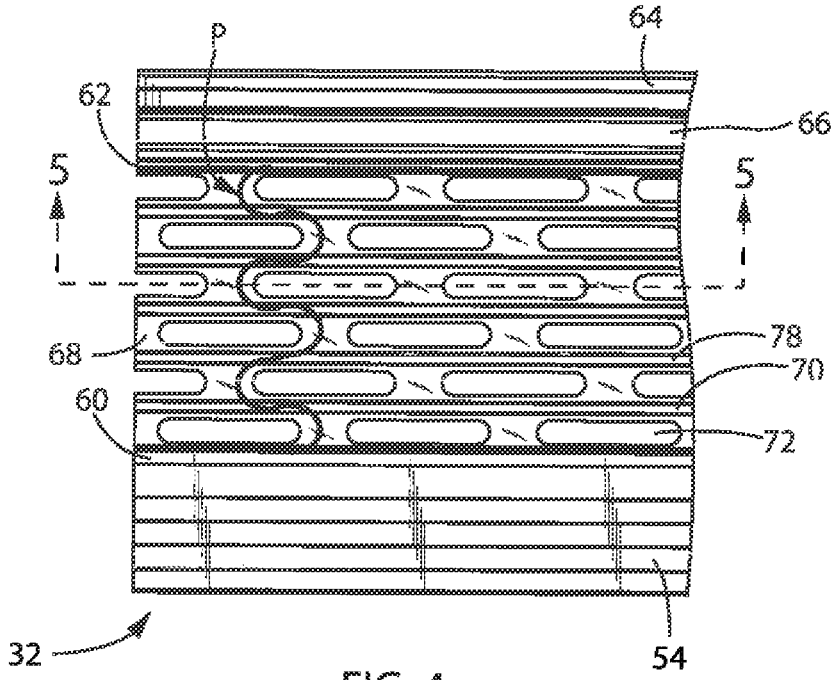
FIG. 4 is top plan view of a section of the frame.
Figure 5:
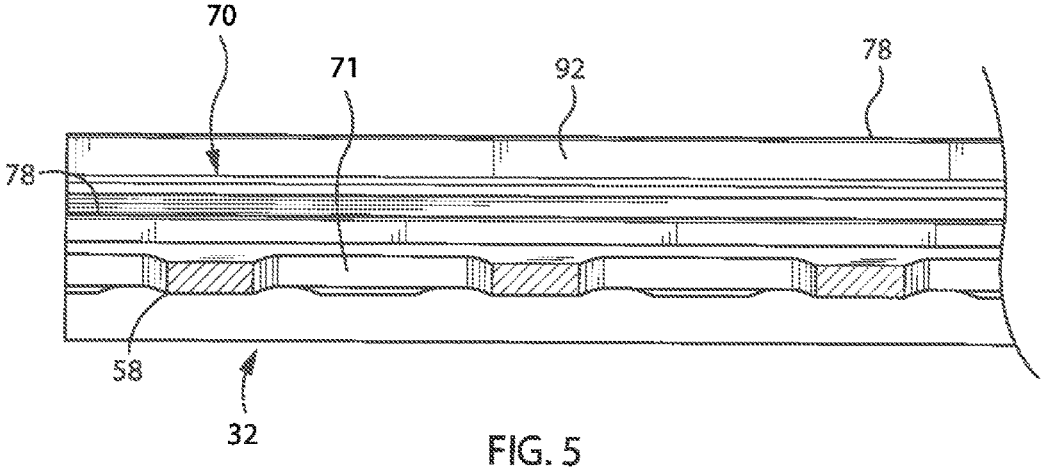
FIG. 5 is a cross sectional side elevation view of the frame, taken generally along line 5-5 in FIG. 4.

Turning to FIGS. 2-5, one embodiment of the frame 32 is illustrated in greater detail. The frame 32 includes a floor 58 with a first, inner side wall 60 and a second, outer side wall 62, all of which extend longitudinally of the gutter 14 once the frame 32 is mounted in place. A mounting flange 54 extends inwardly from the upper edge of the first, inner side wall 60 for attachment to the mounting bracket 30. Another flange 64 is located at the outside of the frame 32 for mounting on the lip 29 on the outer wall 28 of the gutter 14. An optional heating element housing channel 66 may be provided between the outer flange 64 and the second, outer side wall 62 of the frame 32. A plurality (six in the illustrated embodiment) of channels 68 extends longitudinally of the frame 32. Ribs 70 separate the channels 68. Slots 72 are formed in the channels 68 for the passage of water into to underlying gutter 14. The slots 72 are generally oblong and extend longitudinally of the frame 32. As best seen in FIG. 4, slots 72 located in adjacent channels 68 are longitudinally offset from one another. This offset slot configuration produces a relatively short serpentine thermal transfer path "P" laterally across the frame 32 to facilitate heat transfer laterally from the first, inner side wall 60 to the second, outer side wall 62.

Each of ribs 70 extends longitudinally along the length of the frame 32 between adjacent channels 68. Each of the ribs 70 extends from a base 74 defining the tops of the two adjacent channels 68 to an upper surface or tip 78 which, as can be clearly seen in the drawings, extends in a horizontal plane extending between the opposed sides of the associate rib 70. Preferably the tips 78 are all located in the same plane. The tips 78 support the filter screen 34, and keep the filter screen 34 spaced from the floor 58 defined by the bottoms of the channels 68. This is important to maintain continued movement of water through the system 10. Once water passes through the filter screen 34, it can drop directly into the channels 68 or flow down the ribs 70 and drip through the slots 72 into the bottom 24 of the gutter 14. Because the ribs 70 of the frame 32 contact the filter screen 34, the water experiences capillary action and moves downwardly along the rib 70 and eventually through the slots 72 into the gutter 14.

Figure 8:
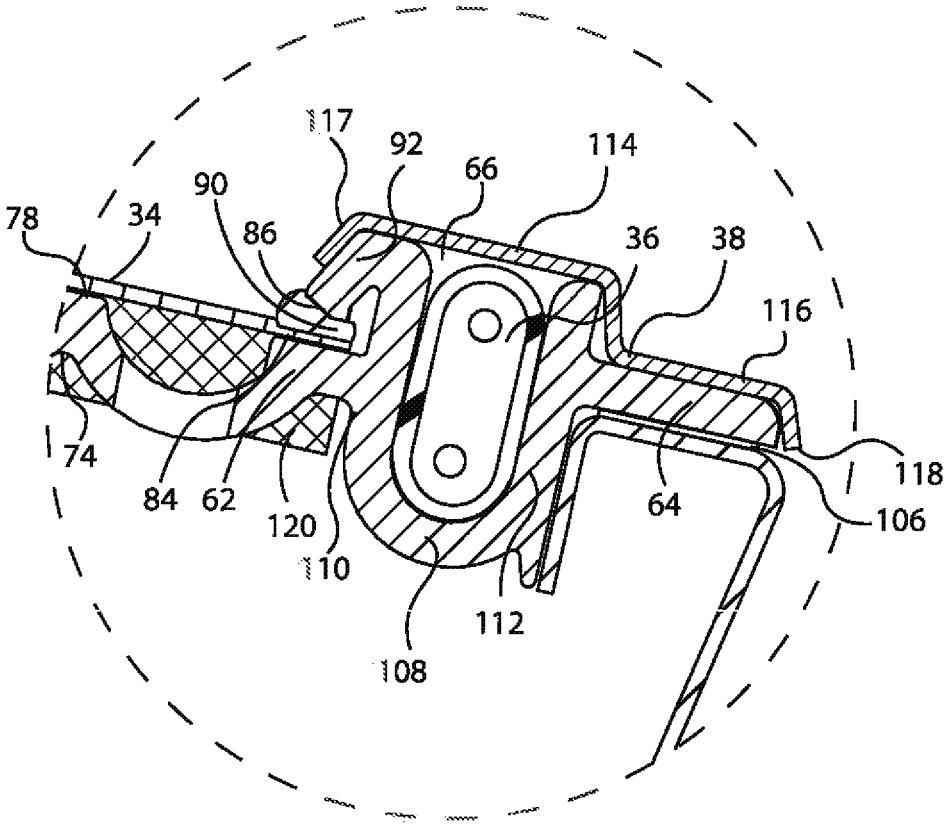
FIG. 8 is a detailed cross sectional view of the frame and the heating element of line 8-8 in FIG. 2, showing a modification to the gutter debris barrier system of FIGS. 1-7.

The channels 68 are generally tapered as a result of the configuration of the ribs 70. As best seen in FIGS. 2 and 8, the channels 68 are arcuate in shape, and more specifically U-shaped. Each rib 70 has first 80 and second 82 opposed surfaces, both of which slope curvilinearly downwardly and outwardly for at least a portion of the height of the rib 70 so as to form parts of adjacent channels 68. Alternatively, the channel 68 could be generally V-shaped or X-shaped. Alternatively still, the ribs 70 may extend from a flat floor at an angle such that the channel 68 formed therein is tapered. Other configurations of channels 68 and ribs 70 are possible, which form other embodiments of tapered channels.

The tapered structure of the channels 68 provides several benefits over comparable gutter guards having vertical ribs and planar channels. First, by having a tapered, preferably arcuate floor 58, as opposed to a flat floor, and by offsetting the slots 72 in adjacent channels 68 in the manner shown, the length of thermal transfer along path "P", defined as a the shortest line that extends in an uninterrupted serpentine path along the surface of the frame from the first, inner side wall 60 to the second, outer side wall 62 without crossing any of the slots 72, is no more than about 5/3, and more preferably no more than about 4/3, of the transverse spacing between the first, inner side wall 60 and second, outer side wall 62 in a horizontal plane. In the illustrated embodiment in which the transverse spacing between the first, inner side wall 60 and second, outer side wall 62 in a horizontal plane is about 3.0 inches, the length of the thermal transfer path "P" is less than 4 inches and more preferably approximately 3.75 inches. In previous models of the same overall dimensions with flat channels and vertically-walled ribs, the thermal transfer path length was approximately 5.88 inches, resulting in a ratio of thermal transfer path to transverse distance "D" of more than 5.75/3.0. The significant reduction in thermal travel path length results in a more efficient system 10 that can be heated more quickly with a heating element 36 having a given thermal output. By reducing the length of the thermal transfer path, the power requirement of the system 10 is reduced.

Additionally, the tapered structure of the channels 68 and the ribs 70 helps to funnel moisture towards the slots 72. The combination of tapered channels 68 and ribs 70 and the location of the slots 72 at the bottom of the channels 68 helps to ensure that all water is funneled through the frame 32 and into the gutter 14. Previous gutter guards having channels with a flat floor and ribs that extend perpendicularly upward did funnel water down towards the frame floor, but not necessarily to the slots. Because the slots were spaced from the ribs in these previous embodiments, there was risk that water would pool along the right-angle edge of the channel. Tapered channels 68 help to alleviate this issue.

Furthermore, structures with curved surfaces are, everything else being equal, stronger than structures with sharp corners. Thus, by providing arcuate channels 68 and tapered ribs 70, the frame 32 is stronger and can withstand greater forces thereon than comparable prior art frames.

The illustrated embodiment features ribs 70 with an approximate height from base 74 to tip 78 between 0.10 to 0.30 inches and more preferably approximately 0.155 inches. Ribs in previous gutter guard systems were typically 0.250 inches in height or higher. Each of the U-shaped channels 68 have an approximate upper radius on the top side of the floor 58 about the center of the channel 68 between 0.100-0.300 inches and more preferably approximately 0.200 inches, and a lower radius beneath the floor 58 about the center of the channel 68 between 0.200-0.400 inches, and more preferably approximately 0.300 inches. Consequently, the typical thickness of the floor 58 is approximately 0.050-0.150 inches and more preferably 0.095 inches. As shown, each channel 68 has a width from tip 78 to adjacent tip 78 of between approximately 0.300 and 0.700 inches and more preferably 0.512 inches.

While the illustrated embodiment shows a frame 32 with six channels 68, additional or fewer channels 68 may be used as desired to accommodate different gutter 14 sizes and/or to form narrower or wider channels 68.

Referring to FIGS. 2, 3, 7, and 8, the first, inner side wall 60 and the second, outer side wall 62 of the frame 32 may each include a shelf 84 with a slot 86 configured to accommodate a respective side 88 of the filter screen 34. When installed in these slots 86, the filter screen 34 rests on top of the shelves 84. Preferably, the shelves 84 are in the same plane as the tip 78 of each rib 70, such that the filter screen 34 can lie flat across the ribs 70 and on top of the shelves 84. The filter screen 34 may then be held in place within the slots 86 using adhesive glue, other attachment devices, or even by crimping. Preferably, a rubberized adhesive 90 (FIG. 8) is used, for instance Dow Corning® 791 weather proofing sealant, which expands and contracts with temperature fluxuation. As a result the filter screen 34 remains tight against the frame 32 regardless of temperature variations.

Referring to FIG. 8, lip 92 may be located above each slot 86 and adjacent to the associated shelf 84. Each lip 92 slopes downwards toward the floor 58 of the frame 32. Again, this encourages movement of any water toward the gutter 14. Additionally, the lip 92 prevents water and icicles from forming over the edge of the filter screen 34 and the gutter 14 once the filter screen 34 becomes saturated with water. It also prevents debris from collecting within the slot 86. As shown, the outer lip 92 is located adjacent to the heating element 36 on the second, outer side wall 62, such that water movement is encouraged away from the heating element 36 and into the gutter 14.

Referring to FIGS. 2-4 and 7, the mounting flange 54 extends laterally inwardly from the first, inner side wall 60 of the frame 32. As shown, the mounting flange 54 narrows in thickness from its outer end 94 to inner end 96. Longitudinally spaced flange ribs or ridges 98 are formed on at least the upper surface 100, and possibly both the upper surface 100 and lower surface 102, of the mounting flange 54 to improve gripping action against the edges of the c-shaped channel 42 in the mounting bracket 30.

In the illustrated embodiment, the mounting flange 54 is approximately between 1.00 and 1.50 inches in length, and more preferably about 1.25 inches. The mounting flange 54 tapers from an initial width of approximately between 0.080 and 0.110 inches and more preferably 0.095 inches at the outer end 94, and narrows to the inner end 96 with a width of approximately between 0.04 and 0.08 inches, and more preferably 0.06 inches. Other flange configurations could be used so long as they are compatible with the mounting bracket 30.

The mounting flange 54 is configured to be releasably secured within the c-shaped channel 42 of the mounting bracket 30 discussed above. Thus, when the system 10 is installed, the mounting flange 54 is first inserted into the c-shaped channel 42 of the mounting bracket 30, which acts as a spring clip to clamp the mounting flange 54 in place. Once the mounting flange 54 is inserted into the c-shaped channel 42, the second, outer flange 64 of the frame 32 rests on the lip 29 on the outer wall 28 of the gutter 14. The outer flange 64 of the frame 32 can then be secured to the lip 29 of the gutter 14 by any suitable attachment device, for instance by screws 104 as shown in FIGS. 2 and 7, and/or by double sided tape 106 as shown in FIG. 8. Thus, the mounting flange 54 need not be physically attached to the c-shaped channel 42 for the frame 32 to remain in place over the gutter 14. Instead, the frame 32 will remain in place due to clamping of the mounting flange 54 within the c-shaped channel 42 of the mounting bracket 30 and the connection between the second, outer side wall 62 of the frame 32 and the outer wall 28 of the gutter 14.

Preferably, the frame 32 is constructed of a metallic material with high thermal conductivity. For instance, in one embodiment, the frame 32 may be constructed of aluminum. This encourages heat transfer throughout the frame 32.

Referring now to FIGS. 1-4, 7, and 8 the optional heating element receiving channel 66 has a bottom 108 and two side walls 110, 112, all of which contact the heating element 36. The first or inner side wall 110 borders the outer end of the shelf 84, and the second or outer sidewall 112 borders the inner end of the outer flange 64. This configuration maximizes the surface area of contact between the frame 32 and the heating element 36, which increases the rate of heat transfer from the heating element 36 to the frame 32.

The heating element 36 is preferably an electrically powered heating wire or cable, although other heat sources may be used. In being located directly adjacent to one of the sides of the frame 32, the heating element 36 provides heat throughout the frame 32 due high conductivity of the frame 32. The channel 66 and heating element 36 are optional and could be eliminated, especially in warm climates.

The cover 38 overlies the heating element 36 and channel 68 as can best be in seen in FIGS. 7-8. The cover 38 has a first or heating element covering section 114 and a second or frame contacting section 116. The first section 114 extends up and over the channel 66 so as to tightly fit over the heating element 36 and the first 110 and second 112 side walls of the heating element receiving channel 66. The first section 114 features a drip lip 117 that funnels water back towards the floor of the frame 32. The second section 116 features a drip lip 118 that funnels water away from the system 10, and out of the gutter 14. Like the frame 32 and the filter screen 34, the cover 38 is preferably made of a thermally conductive material to allow for heat transfer from the heating element 36.

Looking to FIG. 8, the cover 38, second, outer side wall 62 of the frame 32, and the outer wall 28 of the gutter 14 are shown in greater detail. Thus, once assembled, the cover 38 and heating element 36 abut the gutter 14. The cover 38 may be fastened to the second, outer side wall 62 of the frame 32, and further may be fastened to a front lip 29 of the gutter 14. The cover 38 may include openings for screws 104, or could be attached to the frame 32 and the gutter 14 using other suitable attachment devices, such as double-sided tape. This holds the cover 38 in place over the channel 66 and secures the second, outer side wall 62 of the frame 32 to the gutter 14.

Once activated, the heating element 36 can provide heat to the entire system 10. More specifically, the heating element 36 first supplies heat to the channel 68. Heat is then transmitted through the entire frame 32, first through second, outer side wall 112, into the floor 58 and moving up the ribs 70 and to the filter screen 34. The heating element 36 cover 38 is also heated. As the gutter 14 is likely made of a metallic heat transferring material, heat can also be supplied to ensure that no freezing occurs once moisture reaches the gutter 14.

A variety of filter screens 34 may be used with the illustrated invention. Preferably, the filter screen 34 is made of a woven stainless steel wire material that is flexible to allow the filter screen 34 to be spread over the frame 32. Varying grades of stainless steel can be used, for instance 316 or 410 stainless steel alloy. The filter screen 34 collects water, at which point the water experiences capillary action and drops through the filter screen 34. This encourages movement of the water down through the openings in the filter screen 34 and into the gutter 14. Preferably, the stainless steel wire has a high thermoconductivity to encourage heat transfer through the filter screen 34. The openings in the filter screen 34 should be sufficiently small to prevent debris from entry into the gutter 14, while still allowing sufficient water flow to the gutter 14.

Typically, the debris barrier system 10 will be installed in five foot length segments, although other sized segments could be used depending on the exterior layout of a building 12. During installation, a mounting bracket 30 is installed against the fascia 18. A frame section is then prepared for installation by laying the filter screen 34 along the tips 78 of the ribs 70 and the shelves 84. The sides 88 of the filter screen 34 are then inserted into the slots 86 and secured in place using adhesive 90 as described above. Preferably, the filter screen 34 extends longer than the length of the frame 32 so that at least two inches of the filter screen 34 can be bent down on either end of the frame 32 segment to form a vertically extending end 120 seen in FIGS. 2 and 8. Once the mounting flange 54 of the frame 32 is inserted into the c-shaped channel 42 of the mounting bracket 30, the outer flange 64 can be attached to lip 29 on the outer wall 28 of the gutter 14. When the next segment is installed, it will tightly abut the edge of the adjacent section.

It should be understood that the components of the system 10 may be made of any number of different materials. As stated herein, it is preferred that many of these components are made of head-conductive materials, such as aluminum. Other materials could be used to improve the durability, strength, or conductivity of the component. Additionally, while the above description outlines possible attachment devices, it should be noted that any of the components can be attached to one another using screws, bolts, clips, rivets, nails, set-screws, tape, glue, adhesive, and the like.

Additionally, it should be understood that the various inventive features described above can each be used independently of one another or in combination with other features.

It is appreciated that many changes and modifications could be made to the invention without departing from the spirit thereof. Some of these changes will become apparent from the appended claims. It is intended that all such changes and/or modifications be incorporated in the appending claims.

We claim:

1. A debris barrier system for use with a gutter configured to collect water, the gutter having a bottom, a first inner wall located adjacent to a fascia that extends downwardly from the roof of a building, and a second wall spaced outwardly from the first wall, the debris barrier comprising:

a frame adapted to overlie at least a portion of the gutter;

wherein the frame has a floor, a first, inner side wall, and a second, outer side wall, all of which are configured to extend longitudinally of the gutter;

wherein the frame comprises at least two longitudinally extending, laterally spaced upwardly-facing u-shaped channels extending along the floor between the inner and outer side walls, the channels being separated from one another by a longitudinally extending rib that extends upwardly from the floor, wherein the rib has first and second opposed side surfaces, each of which extends upwardly from the floor to a truncated peak forming a planar upper surface that connects the first and second opposed side surfaces, wherein the first and second opposed side surfaces of the rib form respective edges of adjacent upwardly-facing u-shaped channels, each of the channels having a plurality of slots formed in the floor, an upper surface of at least a substantial portion of each of the channels having a generally concave shape when viewed in transverse cross section;

wherein the frame is attachable to the building and the second wall of the gutter such that the frame is held over the bottom of the gutter; and a filter screen covering at least a portion of the frame and resting on the planar upper surface of the rib, the filter screen capable of allowing water to flow therethrough while precluding debris from passing therethrough.

2. The debris barrier system of claim 1, wherein the frame comprises six longitudinally extending, laterally spaced channels separated by five longitudinally extending ribs, wherein the ribs have planar upper surfaces that lie in a common horizontal plane and that support the filter screen.

3. The debris barrier system of claim 2, wherein a height of each rib is approximately 0.155 inches from the floor to the upper surface.

4. The debris barrier system of claim 2, wherein capillary action resulting from the contact between the filter screen and the planar upper surfaces of the ribs increases water movement downwardly into the gutter.

5. The debris barrier system of claim 2, wherein the facing side surfaces of two adjacent ribs are curvilinear in shape so as to form a portion of a U-shaped channel therebetween.

6. The debris barrier system of claim 5, wherein each of the slots extends along a lowest point of the associated channel.

7. The debris barrier system of claim 1, wherein the frame and the filter screen are formed at least partially of a heat conducting material.

8. The debris barrier system of claim 7, further comprising an electrical heating element located in contact with the frame; wherein the electrical heating element has a major axis extending generally vertically relative to the frame.

9. The debris barrier system of claim 1, wherein the filter screen is secured to the inner side wall and outer side wall using an expandable and contractible adhesive.

10. The debris barrier system of claim 1, further comprising a mounting bracket, the mounting bracket configured to extend longitudinally of the gutter and having a generally vertical mounting leg configured for attachment to the fascia and a C-channel extending outwardly from the mounting leg and configured to receive a flange that extends inwardly from the inner side wall of the frame.

11. The debris barrier system of claim 1, wherein the frame is constructed of aluminum.

12. A debris barrier system for use with a gutter configured to collect water, the gutter having a bottom, a first inner wall located adjacent to a fascia that extends downwardly from the roof, and a second wall spaced outwardly from the first wall, the debris barrier system comprising:

an aluminum frame adapted to overlie at least a portion of the gutter;

wherein the frame has a floor, a first, inner side wall, and a second, outer side wall, all of which are configured to extend longitudinally of the gutter;

wherein the frame comprises at least three longitudinally extending, laterally spaced tapered channels extending along the floor between the inner and outer side walls, wherein adjacent tapered channels are separated from one another by longitudinally extending ribs, each rib having first and second opposed tapered side surfaces that extend upwardly from the floor to a planar tip lying in a horizontal plane extending between the first and second opposed side surfaces, each of the tapered channels having a plurality of slots formed in the floor;

wherein the frame is attachable to the fascia and the second wall of the gutter such that the frame is held over the bottom of the gutter; and wherein the frame further comprises a flange that extends inwardly from the inner side wall;

a mounting bracket configured to extend longitudinally of the gutter and having 1) a generally vertical mounting leg configured for attachment to the fascia and 2) a C-bracket extending outwardly from the mounting leg with an upper leg and a lower leg that face one another to define a channel therebetween that is configured to receive a flange of the frame; wherein the mounting bracket is mounted on the fascia directly beneath the roof and to which the flange of the frame is movably attached; wherein the C-bracket is configured to accommodate inward and outward movement of the flange relative to the C-bracket; and wherein facing surfaces of the upper and lower legs are generally planar and are uninterrupted from inner ends thereof to outer ends thereof; and a flat filter screen covering at least a portion of the frame and supported on the planar tips of the ribs, the filter screen capable of allowing water to flow therethrough while precluding debris from passing therethrough.

13. The debris barrier system of claim 12, wherein each of the opposed side surfaces of each rib slopes curvilinearly along at least a bottom portion of the height thereof to a base thereof, and wherein at least a substantial portion of an upper surface of the associated channel is generally concave in transverse-cross section.

14. The debris barrier system of claim 13, wherein the lower leg of the c-bracket extends generally horizontally, and wherein the upper leg of the c-bracket bracket extends downwardly from an inner end thereof toward the outer end thereof.

15. The debris barrier system of claim 12, wherein the frame comprises at least five longitudinally extending, laterally spaced tapered channels, the channels being separated by at least four longitudinally extending ribs that extend from the floor to at least four planar tips lying in a common horizontal plane.

16. The debris barrier system of claim 15, wherein capillary action resulting from the contact between the filter screen and the tips increases water movement downwardly into the gutter.

17. The debris barrier system of claim 12, wherein facing side surfaces of two adjacent ribs form a generally upwardly u-shaped channel therebetween.

18. The debris barrier system of claim 12, wherein the slots in each channel are longitudinally offset from the slots in adjacent channels.

19. The debris barrier system of claim 12, wherein the filter screen is secured to the inner side wall and outer side wall using an expandable and contractible adhesive.

20. The debris harrier system of claim 12, wherein the c-bracket further comprises:

an inner end located adjacent to the generally vertical mounting leg; and an outer end;

wherein the lower leg extends outwardly from the generally vertical mounting leg, wherein the lower leg terminates at a first flange; and wherein the upper leg extends outwardly from the generally vertical mounting leg towards the lower leg, wherein the upper leg terminates at a second flange;

wherein the channel terminates at the first flange and the second flange, and wherein the channel has a width that decreases progressively from an inner end to an outer end thereof.

21. The debris harrier system of claim 12, wherein the upper leg and the lower leg of the C-bracket converge toward one another from the inner ends toward the outer ends thereof so that the channel decreases progressively and linearly in thickness from an inner end thereof to an outer end thereof and so that the upper and lower legs collectively form a spring clip for receiving the flange.

* * * * *